United States Patent [19]

Flesselles et al.

[11] 4,246,774

[45] Jan. 27, 1981

[54] DEVICE FOR MEASURING THE DRAFT OF SMOKING ARTICLES SUCH AS CIGARETTES AND COMBINED MEASURING APPARATUS INCLUDING SUCH A DEVICE

[75] Inventors: Jacques Flesselles; Jean Buisson; Michel Morin, all of Orleans; Jean-Pierre Boittin, Fleury-les-Aubrais; Pierre Tripot, Orleans; Claude Vallée, Chaingy, all of France

[73] Assignee: Service 0'Exploitation Industrielle des Tabacs et des Allumettes, Paris, France

[21] Appl. No.: 56,292

[22] Filed: Jul. 10, 1979

[30] Foreign Application Priority Data

Jul. 13, 1978 [FR] France ..... 78 20930
Jul. 13, 1978 [FR] France ..... 78 20931

[51] Int. Cl.[3] ..... G01N 15/08
[52] U.S. Cl. ..... 73/38
[58] Field of Search ..... 73/38, 45, 45.1, 45.2

[56] References Cited

U.S. PATENT DOCUMENTS 3,386,281 6/1968 Menge et al. ..... 73/38 X
4,181,007 1/1980 Arisaka et al. ..... 73/38 X

FOREIGN PATENT DOCUMENTS 1025173 2/1958 Fed. Rep. of Germany ..... 73/38

*Primary Examiner*—Gerald Goldberg
*Assistant Examiner*—Joseph W. Roskos
*Attorney, Agent, or Firm*—Holman & Stern

[57] ABSTRACT

A device for measuring the draft of cigarettes comprises a vertical tubular body in which cigarettes are fed one by one. A first sphincter-member mounted inside the body is operable to prevent a cigarette from falling and stop it in a given position. A second sphincter-member positioned above the first member is actuated when the first member is released so as to hold the cigarette in the above given position. A seal is provided at the bottom side of the tubular body to define a gas-tight chamber with the second sphincter-member, and an orifice connected to a source of air under vacuum is formed in the body between the first sphincter-member and the seal.

8 Claims, 7 Drawing Figures

DEVICE FOR MEASURING THE DRAFT OF SMOKING ARTICLES SUCH AS CIGARETTES AND COMBINED MEASURING APPARATUS INCLUDING SUCH A DEVICE

The present invention relates to a device for measuring the draft of smoking articles of cylindrical shape such as cigarettes, filter-tips or filter-tipped cigarettes. The invention also relates to an apparatus for measuring various physical characteristics of said smoking articles including such a draft-measuring device.

The draft of a cigarette or the like is the physical characteristic which measures the aptitude of the product to allow a current of air to pass therethrough, said air circulating therethrough under determined conditions.

It is an essential characteristic for the manufacturer since it is of considerable influence on the smoker's satisfaction.

German Pat. No. 1,025,173 discloses a draft-measuring device comprising a body defining a bore for receiving a cigarette, the bottom of the bore forming a stop for the cigarette, at least one membrane fixed to the body so as to provide tightness when a cigarette is introduced in the bore, and a source of vacuum.

This known device implies the manual introduction of the cigarettes one by one, then their extraction, also by hand, once the measurement is effected. An automatic operation can therefore not be envisaged. In addition, such a device is not adapted to be integrated within a measuring line in which the cigarettes are moved from one station to another, because it interrupts the circulation of the cigarettes.

One object of the present invention is to provide a device in which the displacement of the article and measurement are automatic, and which may advantageously be combined with other measuring devices for forming a measuring line.

The concept of the invention is to shape the device as a vertical tube which the articles traverse one by one by gravity and to provide means for stopping the article introduced in the tube and for allowing then measurement of the draft thereof.

More specifically, there is provided according to the invention a device for measuring the draft of smoking articles of cylindrical shape, such as cigarettes, filter-tips, or filter-tipped cigarettes, comprising a tubular body, whose inner diameter is greater than the diameter of said articles, disposed vertically, means for feeding the articles one by one above the body and for directing them along the axis of the body, means operable to obturate the body thereby to stop an article in a given position, means for sealingly holding the article in said position, actuated when said obturation means is released, sealing means for defining with said holding means a gas-tight chamber inside the body, placed below said obturation means, and an orifice formed in the body between said obturation means and said sealing means and connected to a source of air under vacuum.

A cycle of measurement then comprises four phases. In the first, the article is introduced into the tubular body and it is stopped by the obturation means. In the second phase, the obturation means is released, but the article is prevented from descending in the body by the holding means. The sealing means is actuated. In the third phase, which corresponds to the actual measurement of the draft, a vacuum is applied via said orifice to the chamber defined inside the body between the holding means and the sealing means. Finally, in the fourth phase, the holding means is released, as well as the sealing means and the article is discharged by gravity.

The holding means and the obturation means are preferably constituted by sphincter-like members connected to a source of compressed air and to a source of vacuum.

In an advantageous embodiment, the feeding means comprises a transfer tube which may receive an article, rotatable between a horizontal position, in which it may receive an article discharged from a horizontal guiding element, and a vertical position, in which it is aligned with the tubular body, and an arctuate ramp arranged to prevent an article from falling from the transfer tube in the course of rotation thereof.

Another object of the invention is a combined apparatus for measuring the physical characteristics of smoking articles, characterised in that it comprises a device for measuring the draft, as defined hereinabove, and an upstream measuring device incorporating said guiding element, which the articles traverse along a horizontal path.

The combined measuring apparatus may further comprise transfer means for collecting the articles discharged by gravity from the draft-measuring device one by one and for delivering them in horizontal position.

The transfer means preferably comprises a member of rectangular section capable of receiving an article, closed at its downstream end, rotatable between a vertical position, in which it may receive the articles discharged from the draft-measuring device, and a horizontal position, said member being formed of two elements each comprising two perpendicular walls, one of which is hinged with respect to the other about an edge, and a fixed stop to pivot the movable element when said member reaches said horizontal position thereby to allow the article to be laterally discharged.

The invention will be more readily understood on reading the following description with reference to the accompanying drawings, in which.

Figure 1:
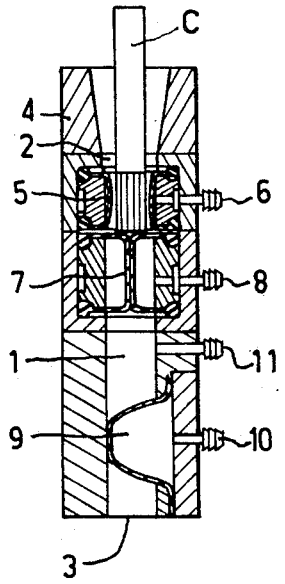
FIG. 1 is a section of the draft measuring device according to the invention, in a first state.
Figure 2:
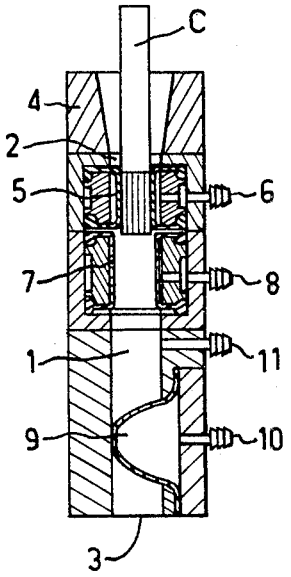
FIG. 2 is similar to FIG. 1 but shows a second state.

The device for measuring the draft of cigarettes shown in FIGS. 1 and 2 comprises a cylindrical tube 1 mounted vertically on a frame, not shown, and having an upper or upstream opening 2 and a lower or downstream opening 3. For the terms downstream and upstream, it is referred to the direction of travel of the cigarettes.

At the upstream opening 2 is attached a funnel-like guide for guiding and centering a cigarette C during its introduction in the device.

On the internal surface of tube 1 adjacent the upstream opening 1 there is a sphincter 5 i.e. a ring-like elastomeric membrane, connected via duct 6 to a source of vacuum, not shown, for instance a vacuum pump, and also optionally to a source of comprssed air, not shown.

Adjacent sphincter 5 there is a further sphincter 7, designated as downstream sphincter, connected via duct 8 to a source of vacuum and a source of compressed air, not shown.

In the vicinity of the downstream opening 3, on the internal surface of tube 1, there is provided a membrane valve 9 connected via duct 10 to a source of compressed air.

Between the downstream sphincter 7 and the membrane valve 9 there is a duct 11 connected to a draft measuring member of a known type, not shown. This member measures the loss of pressure ascribable to cigarette C introduced in the device.

The device operates in the following manner:

A cigarette C is introduced in tube 1 through the upstream opening 2. It is centered by guide 4.

The device is in the state shown in FIG. 1, the upstream sphincter 5 is depressed and leaves the passage clear. The downstream sphincter 7 is under pressure and closes the section of tube 1. The cigarette C bears on the downstream sphincter. In this stage, the state of the membrane valve 9 is not critical: it may be under pressure or depressed.

For measuring the draft, the device takes the position shown in FIG. 2, the membrane valve 9 is subjected to compressed air (if not previously) and closes the section of tube 1 to achieve a gas-tight closure of downstream opening 3.

The upstream sphincter 5 is released or subjected to compressed air to achieve a gas-tight closure of upstream opening 2 and hold in position cigarette C. Simultaneously, the downstream sphincter 7, previously subjected to pressure, is released or drawn by vacuum.

Valve 9 and sphincter 5 thus define a gas-tight chamber inside the tube 1. The draft measuring member is then actuated.

Once the meaurement is carried out and recorded, the pressure acting on membrane valve 9 is released and the sphincters 5 and 7 are drawn.

Cigarette C is no longer held by upstream sphincter 5 and it is discharged by gravity towards the downstream opening 3 which allows passage since the membrane valve 9 is now released or drawn.

Figure 3:
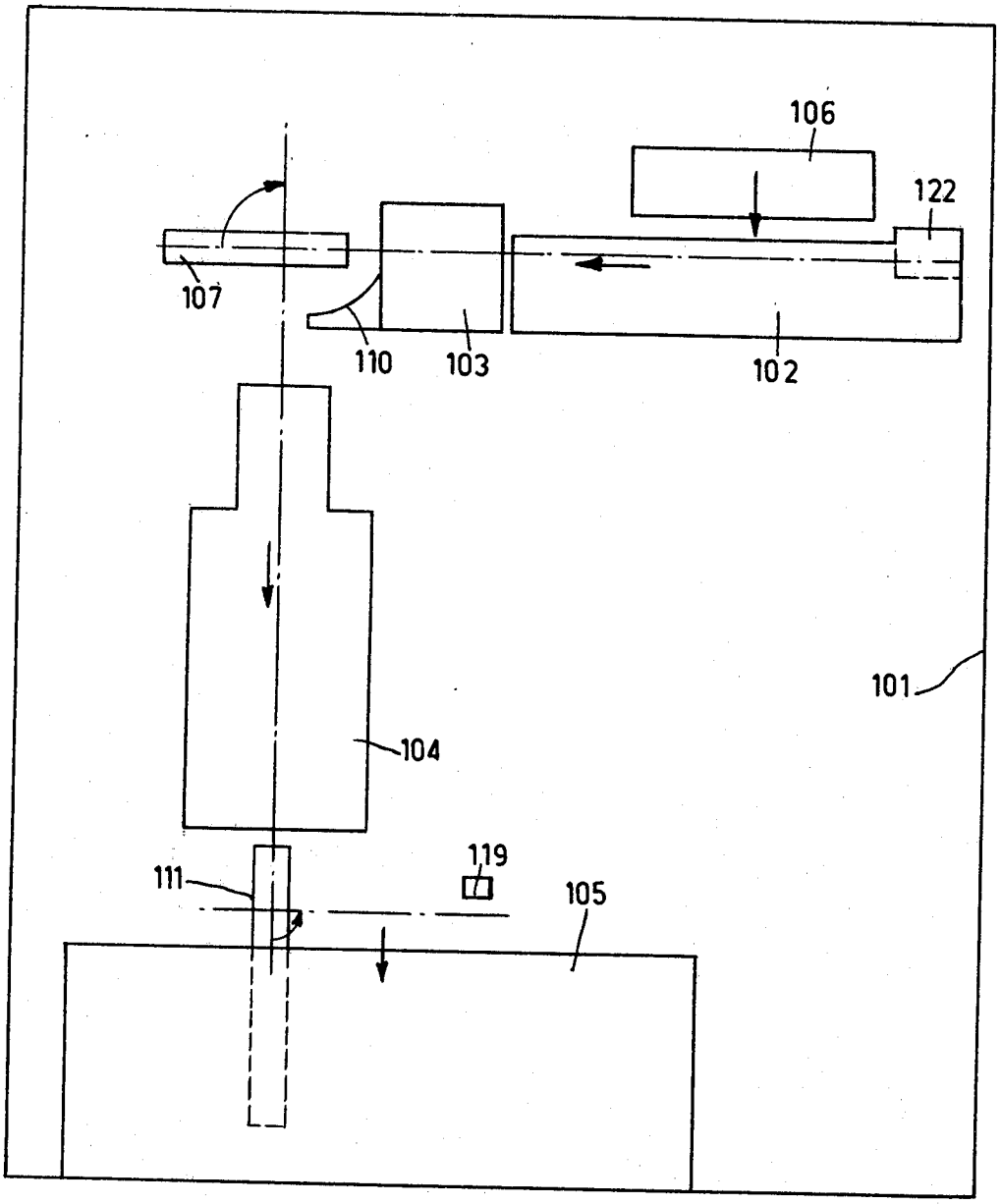
FIG. 3 shows schematically a combined measuring apparatus according to the invention, including a device as shown in FIGS. 1 and 2.

There is shown in FIG. 3 a combined apparatus for measuring various physical proprieties of cigarettes or the like, which comprises several measuring units among which a draft measuring device as described above.

Referring to FIG. 3, the apparatus comprises a vertical frame 101 on which are attached the measuring units: weight measuring unit 102, diameter measuring unit 103, draft measuring unit 104, compactness measuring unit 105.

Unit 102 is conventionally made of an electronic balance.

Unit 103 is made of a conventional diameter measuring ring.

Unit 104 consists of the device described above and shown in FIGS. 1 and 2.

Unit 105 may be a conventional device, but it will be preferably a device of the type disclosed in copending French Patent application No. 78 20929.

These devices are therefore conventional with the exception of unit 104 and optionally unit 105 and will not be described in detail in the present specification.

The measurement data supplied by the various stations are collected and recorded in a conventional data processing unit.

The apparatus thus described comprises a first section in which the cigarettes travel along a horizontal course, including the weight measuring unit 102 and the diameter measuring unit 103, a second section in which the course followed by the cigarettes is vertical, consisting of the draft measuring unit 104, and a third section in which the cigarettes take again a horizontal position, consisting of the compactness measuring unit 105.

Above the weight measuring unit 102 there is provided a hopper 106 which receives the cigarette C which it is desired to test and delivers same one by one to the weight measuring unit 102 by means of a drum provided with recesses, not shown.

Figure 4:
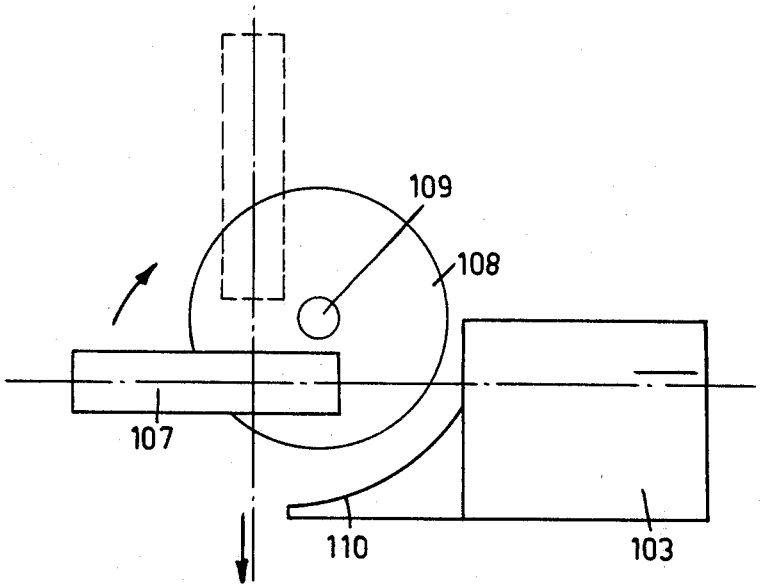
FIG. 4 shows the transfer device mounted upstream of the draft measuring device.

As shown in FIG. 4, the transfer device for passing a cigarette from the horizontal to the vertical course is made of a tube 107 attached to a disk 108 rotatable about its axis 109 with respect to the frame. A ramp 110 secured to frame 101 prevents the cigarette from falling outside its intended course upon rotation of disk 108.

Figure 5:
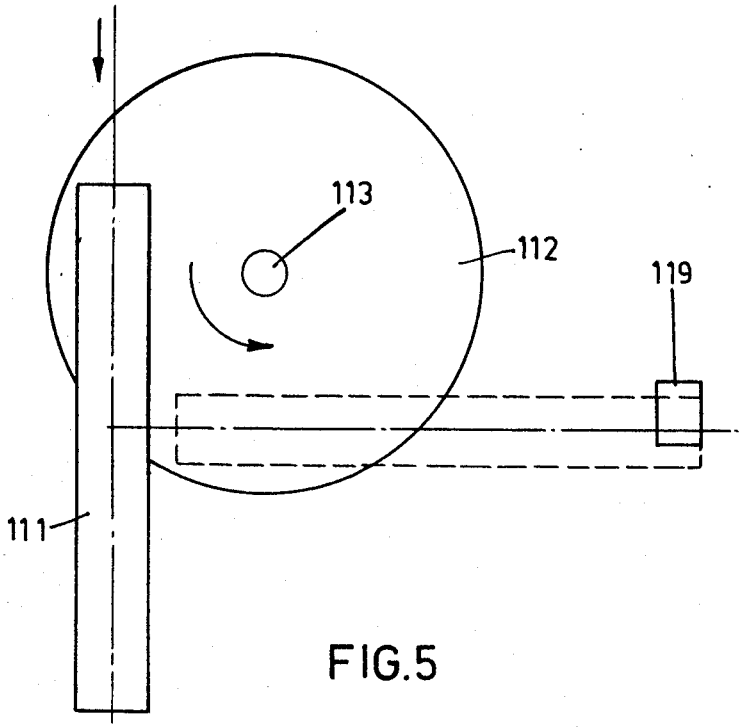
FIG. 5 shows the transfer device mounted downstream of the draft measuring device.

Referring to FIG. 5, the device for transferring a cigarette from the vertical course to the horizontal course comprises a tube 111 with a rectangular cross-section attached to a disk 112 rotatable about its axis 113 with respect to frame 101.

Figure 6:
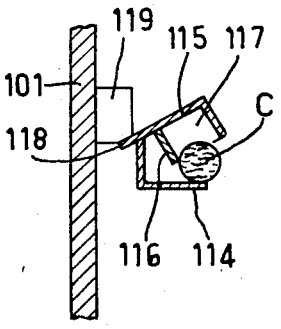
FIG. 6 shows a section of the transfer device of FIG. 5 in horizontal position.

The specific structure of tube 111 will be described with reference to FIG. 6 in which the tube in horizontal position is shown in section.

The tube 111 is composed of two parts, namely a fixed part and a part movable with respect to the fixed part. The fixed part 114 comprises the bottom wall and the rear lateral wall of tube 111. At the upper edge of the fixed part is hinged the movable part 115 composed of the upper wall and the front wall of tube 111. There is further provided a wall 116 parallel to the front wall of tube 111, secured to the movable part 115 adjacent the hinge of the movable part.

The movable part 115 is closed at its downstream end by a wall 117 which is extended at its upper rear end by a lug 118 engageable with a stop 119 secured to the frame 101 so as to cause the movable part to pivot and hence the tube to open when the latter is horizontal.

Figure 7:
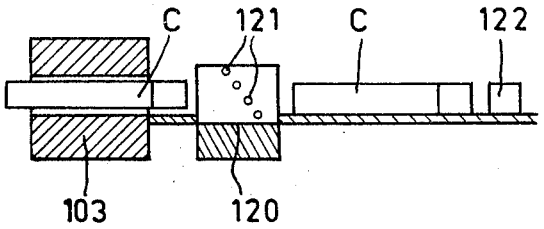
FIG. 7 shows schematically the measuring stations provided upstream of the draft measuring device.

Referring now to FIG. 7, there is provided between the weight measuring unit 102 and the diameter measuring unit 103 a gas barrier member shown in schematic manner. The latter comprises a V-shaped guide 120 the walls of which define a plurality of openings 121 connected to a source of compressed air, not shown. The openings are disposed on a line inclined at about 60° with respect to the horizontal, so that the air flowing out of the openings 121 is directed towards the diameter measuring unit 103.

The apparatus operates as follows:

A cigarette $C_n$ discharged from hopper 106 is placed on the support of the balance of the weighting unit 102. Once the weight measurement is carried out, cigarette $C_n$ is moved by a pusher 122 towards the diameter measuring unit 103 and introduced into the measuring ring.

When pusher 122 has returned to its starting position, a cigarette $C_{n+1}$ is discharged from the hopper and fed to the weight measuring unit 102.

The measurement of the weight of cigarette $C_{n+1}$ and measurment of the diameter of cigarette $C_n$ are carried out simultaneously. The diameter measurement is carried out by means of compressed air, so that an undesirable air flow may escape from the measuring ring 103 to disturb operation of unit 102. To overcome this defect, the opening 121 formed in the guide 120 are connected to a source of compressed air. The openings 121 are disposed on a line inclinded at about 60° with respect to the horizontal and directed towards unit 103 and this arrangement results in that an air flow is directed towards unit 103 and creates a barrier to the air flow liable to escape from the measuring ring.

Once these measurements are effected, pusher 122 moves towards unit 103 cigarette $C_{n+1}$ which thrusts cigarette $C_n$ inside the transfer tube 107 in horizontal position. Disk 108 rotates by 90° about its axis 109 in the direction of the arrow. As disk 108 rotates, the cigarette $C_n$ received therein goes down and its lower end comes into engagement with ramp 110 until it is in vertical position. At this stage, the cigarette falls by gravity inside the draft measuring unit 104.

Disk 108 then rotates by 90° in the opposite direction and returns tube 107 to its starting position. At the same time, pusher 122 has also returned to its starting position and the next cigarette $C_{n+2}$ is fed to the weight measuring unit.

The following measurements are then carried out simultaneously: draft measurement for cigarette $C_n$, diameter measurement for cigarette $C_{n+1}$ and weight measurement for cigarette $C_{n+2}$.

Once there measurements are carried out, cigarette $C_{n+2}$ is moved towards unit 103 where it thrusts cigarette $C_{n+1}$ inside transfer tube 107. Simultaneously, cigarette $C_n$ is discharged from the draft measuring unit 104 into the transfer tube 111, in which it is prevented from falling by the closing wall 117.

Disk 112 then rotates by 90° about its axis 113 in the direction of the arrow. In the course of this rotation, tube 111 is moved from a vertical position to a horizontal position and the cigarette $C_n$ received therein takes also a horizontal position.

When reaching this horizontal position, lug 118 secured to movable part 115 engages stop 119. The motion causes raising the movable part 115 hinged on the fixed part 114. This results in opening of the tube and discharging the cigarette $C_n$ which is ejected by the impulse imparted by wall 116 which is rigid with movable part 115 and pivots too. Cigarette $C_n$ is then fed to the compactness measuring unit 105.

Simultaneously, cigarette $C_{n+1}$ transferred by tube 107 is fed to the draft measuring unit 104 and the next cigarette $C_{n+3}$ is fed to the weight measuring unit 102.

Four measurements are then carried out at the same time, namely compactness measurement for cigarette $C_n$, draft measurement for cigarette $C_{n+1}$, diameter measurement for cigarette $C_{n+2}$ and weight measurement for cigarette $C_{n+3}$.

Once the compactness is measured for cigarette $C_n$, the latter is discharged from unit 105 and a new cycle may start.

The above-described apparatus enables cigarette batches to be automatically tested with one operator only for conducting the apparatus and a number of measurements to be carried out at a high rate. It further allows recording and centralizing the measures found for each cigarette.

What is claimed is:

1. A device for measuring the draft of smoking articles of cylindrical shape comprising a tubular body, whose inner diameter is greater than the diameter of said articles, disposed vertically, means for feeding the articles one by one above the body and for directing them along the axis of the body, means operable to obturate the body thereby to stop an article in a given position, means for sealingly holding the article in said position, actuated when said obturation means is released, sealing means for defining with said holding means a gas-tight chamber inside the body, placed below said obturation means, and an orifice formed in the body between said obturation means and said sealing means and connected to a source of air under vacuum.

2. A device as claimed in claim 1, wherein said holding and said obturation means are constituted by sphincter-like members connected to a source of compressed air and to a source of a vacuum.

3. A device as claimed in claim 1, wherein said feeding means comprises a transfer tube which may receive an article, rotatable between a horizontal position, in which it may receive an article discharged from a horizontal guiding element, and a vertical position, in which it is aligned with the tubular body, and an arcuate ramp arranged to prevent an article from falling from the transfer tube in the course of rotation thereof.

4. A combined apparatus for measuring the physical characteristics of smoking articles, comprising a draft measuring device as defined in claim 3 and an upstream measuring unit incorporating said guiding element, which the articles traverse along a horizontal path.

5. An apparatus as claimed in claim 4 comprising transfer means for collecting the articles discharged by gravity from the draft measuring device one by one and for delivering them in horizontal position.

6. An apparatus as claimed in claim 5, wherein said transfer means comprise a member of rectangular section capable of receiving an article, closed at its downstream end, rotatable between a vertical position, in which it may receive the articles discharged by gravity from the draft measuring device, and a horizontal position, said member being formed of two elements each comprising two perpendicular walls, one of which is hinged with respect to the other about an edge, and a fixed stop to pivot the movable element when said member reaches said horizontal position thereby to allow the article to be laterally discharged.

7. An apparatus as claimed in claim 4, wherein said upstream measuring unit is a diameter measuring ring operating with compressed air, a further measuring unit is provided upstream of said measuring ring, the articles travelling from said further measuring unit to said measuring ring along a horizontal course, and means are provided to point an air jet between said unit and said measuring ring.

8. An apparatus as claimed in claim 7, wherein said air jet is inclined at 60° with respect to the horinzontal.

* * * * *